US011401621B2

(12) United States Patent
Marmann et al.

(10) Patent No.: US 11,401,621 B2
(45) Date of Patent: Aug. 2, 2022

(54) METHOD OF PRODUCING A METAL STRIP COATED WITH A COATING OF CHROMIUM AND CHROMIUM OXIDE USING AN ELECTROLYTE SOLUTION WITH A TRIVALENT CHROMIUM COMPOUND AND ELECTROLYSIS SYSTEM FOR IMPLEMENTING THE METHOD

(71) Applicant: thyssenkrupp Rasselstein GmbH, Andernach (DE)

(72) Inventors: Andrea Marmann, Piesport (DE); Christoph Molls, Bonn (DE); Sebastian Hartung, Kaufungen (DE)

(73) Assignee: thyssenkrupp Rasselstein GmbH, Andernach (DE)

( * ) Notice: Subject to any disclaimer, the term of this patent is extended or adjusted under 35 U.S.C. 154(b) by 86 days.

(21) Appl. No.: 16/840,677

(22) Filed: Apr. 6, 2020

(65) Prior Publication Data

US 2020/0325590 A1 Oct. 15, 2020

(30) Foreign Application Priority Data

Apr. 9, 2019 (DE) ..... 10 2019 109 356.2

(51) Int. Cl.
*C25D 7/06* (2006.01)
*C25D 3/06* (2006.01)
(Continued)

(52) U.S. Cl.
CPC ..... *C25D 7/0614* (2013.01); *C25D 3/06* (2013.01); *C25D 17/02* (2013.01); *C25D 17/28* (2013.01)

(58) Field of Classification Search
None
See application file for complete search history.

(56) References Cited

U.S. PATENT DOCUMENTS 6,099,714 A 8/2000 Bibber
2015/0329981 A1* 11/2015 Wijenberg ..... C25D 9/08 428/626
(Continued)

FOREIGN PATENT DOCUMENTS

WO 2014/079909 A1 5/2014
WO 2015/177314 A1 11/2015
(Continued)

OTHER PUBLICATIONS

Result of examination report for German Patent Application No. 10 2019 109 356.2 filed Apr. 9, 2019.

*Primary Examiner* — Wojciech Haske
(74) *Attorney, Agent, or Firm* — Paul D. Bianco; Katharine Davis; Fleit Intellectual Property Law

(57) ABSTRACT

A method of producing a metal strip coated with a coating, said coating containing chromium metal and chromium oxide and being electrolytically deposited from an electrolyte solution that contains a trivalent chromium compound and at least one salt for increasing conductivity and at least one acid or one base for setting a desired pH value, onto the metal strip by bringing the metal strip into electrolytically effective contact with the electrolyte solution during an electrolysis time. The metal strip is successively passed at a predefined strip travel speed in a strip travel direction through a plurality of electrolysis tanks successively arranged in the strip travel direction. At least the first electrolysis tank, as viewed in the strip travel direction, or a front group of electrolysis tanks is filled with a first electrolyte solution and the last electrolysis tank, as viewed in the strip travel direction, or a rear group of electrolysis tanks is filled with a second electrolyte solution. The second electrolyte solution contains no additional components apart from the trivalent chromium compound as well as the at least
(Continued)

one salt and the at least one acid or base and is especially free of organic complexing agents and free of buffering agents.

14 Claims, 4 Drawing Sheets

(51) Int. Cl.
*C25D 17/02* (2006.01)
*C25D 17/28* (2006.01)

(56) References Cited

U.S. PATENT DOCUMENTS

2016/0138178 A1* 5/2016 Wijenberg ..... C25D 17/10
428/648
2017/0081773 A1* 3/2017 Wijenberg ..... C25D 7/0621

FOREIGN PATENT DOCUMENTS

WO WO-2015177315 A1 * 11/2015 ..... C25D 5/627
WO 2018/087135 A1 5/2018

* cited by examiner

METHOD OF PRODUCING A METAL STRIP COATED WITH A COATING OF CHROMIUM AND CHROMIUM OXIDE USING AN ELECTROLYTE SOLUTION WITH A TRIVALENT CHROMIUM COMPOUND AND ELECTROLYSIS SYSTEM FOR IMPLEMENTING THE METHOD

FIELD OF THE DISCLOSURE

The present disclosure relates to a method of producing a metal strip coated with a coating and to an electrolysis system for electrolytically depositing a chromium- and chromium oxide-coating onto the surface of a metal strip.

BACKGROUND

It is known from the prior art that in the production of packaging materials, electrolytically coated sheet steel coated with a coating of chromium and chromium oxide can be used, which sheet steel is known as blackplate ("Tin Free Steel," TFS) or as "Electrolytic Chromium Coated Steel" (ECCS) and which is an alternative to tinplate. This tin-free steel is marked by an especially favorable adhesion for paints or organic protective coatings (for example, polymer coatings of PP or PET). Despite the low thickness of the coating of chromium and chromium oxide, which, as a rule, is less than 20 nm, this chromium-coated sheet steel is marked by good corrosion resistance and good workability in deformation processes used in the production of packaging materials, for example, in deep drawing processes and ironing processes.

To coat the steel substrate with a coating containing metallic chromium and chromium oxide, it is known from the prior art to use electrolytic coating methods, by means of which the coating is deposited in a strip coating system onto strip-shaped sheet steel using a chromium(VI)-containing electrolyte. However, these coating methods have serious drawbacks due to the environmentally harmful and health-threatening properties of the chromium(VI)-containing electrolytes used in the electrolytic process and will have to be replaced with alternative coating methods in the not too distant future, since the use of chromium(VI)-containing materials will soon be prohibited.

For this reason, electrolytic coating methods, which obviate the use of chromium(VI)-containing electrolytes, have already been developed in the state of the art. For example, WO 2015/177314-A1 discloses a method for the electrolytic coating of strip-shaped sheet steel with a chromium metal/chromium oxide (Cr/CrOx) layer in a strip coating system in which the sheet steel, which is connected as the cathode, is passed at high strip travel speeds of more than 100 m/min through a single electrolyte solution that contains a trivalent chromium compound (Cr(III)) as well as a complexing agent and a salt that increases conductivity and is free of chlorides and buffering agents such as boric acid. Organic substances, especially formates and preferably sodium or potassium formate, are then used as complexing agents. The electrolyte solution can contain sulfuric acid to adjust a preferred pH value in the range of 2.5 to 3.5. The coating of chromium metal and chromium oxide can be deposited layer by layer in successive electrolysis tanks or in strip coating systems arranged one after the other, each electrolysis tank being filled with the same electrolyte solution.

It was then observed that the electrolytically deposited coating also can contain chromium sulfates and chromium carbides, in addition to the components chromium metal and chromium oxide, and that the fractions of these components in the total coating weight of the passivation layer depends significantly on the current densities used in the electrolysis tanks. It was established that three regions (regime I, regime II and regime III) are formed as a function of the current density, in which no chromium-containing deposition on the steel substrate occurs in a first region with low current density up to a first current density threshold (regime I), a linear relation exists between current density and coating weight of the deposited coating layer in a second region with medium current density (regime II) and partial decomposition of the applied coating layer occurs at current densities above a second current threshold (regime III), so that the coating weight of chromium of the coating layer in this regime initially diminishes with increasing current density and is then set at an equal value at higher current densities. In the region with medium current density (regime II) essentially metallic chromium is deposited on the steel substrate with a weight fraction of up to 80% (referred to the total weight of the passivation layer) and above the second current density threshold (regime III), the coating layer contains a higher fraction of chromium oxide, which accounts for between ¼ and ⅓ of the total coating weight of the coating layer in the region of higher current densities. The values of the current density thresholds that delimit the regions (regime I to regime III) from each other are then dependent on the strip travel speed with which the steel sheet is moved through the electrolyte solution.

As mentioned in WO 2014/079909 A1, to ensure that blackplate (uncoated sheet steel) coated with a chromium/chromium oxide coating has a sufficiently high corrosion resistance for use in packaging applications, a minimum coating weight of at least 20 $mg/m^2$ is required in order to achieve a corrosion resistance comparable to that of conventional ECCS. Furthermore, it was found that to achieve a sufficiently high corrosion resistance for use in packaging applications, the coating must have a minimum coating weight of chromium oxide of at least 5 $mg/m^2$. To ensure that the coating has such a minimum coating weight of chromium oxide, it appears to be advisable to apply high current densities during the electrolytic process in order to be able to operate in the region (Regime III) in which a coating with a relatively high weight portion of chromium oxide is deposited onto the steel substrate. Consequently, to obtain a coating with a high weight portion of chromium oxide, high current densities would have to be used. However, achieving high current densities in the electrolysis tanks requires a considerably expenditure of energy for applying high currents to the anodes.

SUMMARY

Thus, one aspect of the disclosure relates to the most efficient, cost-effective and energy-saving method possible for producing a metal strip coated with a chromium oxide-containing coating, using an electrolyte solution with a trivalent chromium compound. At the same time, it is important that the use of chromium(VI)-containing substances, including in the form of intermediate products forming during the electrolytic process, be avoided in order to be able to fully comply with the statutory provisions with respect to the prohibition of chromium(VI)-containing substances. In addition, the metal strip coated according to the disclosed method should have as high a corrosion resistance as possible and form a good adhesive base surface for organic cover coats, e.g., for organic paints and for polymer coatings, especially for polymer films made, for example, of PET, PE or PP.

Preferred embodiments of the method and of the electrolysis system are disclosed.

According to the method of the present disclosure, a coating containing chromium metal and chromium oxide/chromium hydroxide is electrolytically deposited from an electrolyte solution, which contains a trivalent chromium compound and at least one salt for increasing the conductivity and at least one acid or one base for setting a desired pH value, onto a metal strip, especially a steel strip, by bringing the metal strip into electrolytically effective contact with the electrolyte solution, with the metal strip being successively passed at a predefined strip travel speed in the strip travel direction through a plurality of electrolysis tanks which are successively connected to each other in the strip travel direction, with at least the first electrolysis tank, as viewed in the strip travel direction, or a front group of electrolysis tanks being filled with a first electrolyte solution, and with the last electrolysis tank, as viewed in the strip travel direction, or a rear group of electrolysis tanks being filled with a second electrolyte solution, with the second electrolyte solution containing no constituents other than a trivalent chromium compound and at least one salt and at least one acid or base and, especially, being free of organic complexing agents and free of buffering agents. To this end, no chromium(VI)-containing substances, including substances in the form of intermediate products, are used, thus ensuring that the method is carried out completely free of chromium(VI)-containing substances and therefore poses no risk to the environment and health during its implementation.

Surprisingly, it has been found that it is possible to electrolytically deposit a chromium-containing layer onto the surface of the metal strip without using organic complexing agents, such as formates, as constituents of the electrolyte solution, with the layer deposited using an electrolyte solution without organic complexing agents consisting, at least for the most part, only of chromium oxide and/or chromium hydroxide. It has also been shown that a layer consisting of pure chromium oxide/chromium hydroxide and forming the surface of the coating is beneficial with respect to the corrosion resistance and the adhesive strength for organic coatings, such as paints or polymer layers. The method of the present disclosure therefore proposes that the last electrolysis tank, as viewed in the strip travel direction, or the rear group of electrolysis tanks contain a second electrolyte solution which does not contain any organic complexing agents. In this manner, it is possible to produce a layer consisting, at least for the most part, of pure chromium oxide and/or chromium hydroxide on the surface of the coating. In contrast, the layers lying beneath the coating which are deposited in the upstream electrolysis tank(s), as viewed in the strip travel direction, in addition to a chromium oxide/chromium hydroxide portion also contain a portion of metallic chromium since the upstream electrolysis tanks contain a first electrolyte solution which contains (organic) complexing agents, especially formates, such as sodium or potassium formate. Thus, the coating electrolytically deposited onto the surface of the metal strip is composed of a plurality of layers lying one on top of the other, with the lower layer(s) containing a mixture of chromium metal and chromium oxide and/or chromium hydroxide and, where applicable, additional chromium compounds, such as chromium carbides, and with the uppermost layer which forms the surface of the coating consisting, at least for the most part, of pure chromium oxide and/or chromium hydroxide. The coating weight of the individual layers can be controlled especially by the length of electrolysis time in the individual electrolysis tanks and thus be set to the values desired.

In this context, any reference to chromium oxide is intended to include all forms of oxides of chromium (CrOx), including chromium hydroxides, especially chromium(III) hydroxide and chromium(III) oxide hydrate, and mixtures thereof. Especially preferred are the compounds of chromium and oxygen in which the chromium is present in trivalent form, especially in the form of dichromium trioxide ($Cr_2O_3$). Thus, in addition to metallic chromium, the coating preferably contains only trivalent chromium compounds and most preferably only trivalent chromium oxides and/or chromium hydroxides.

The uppermost layer of the coating, which is deposited in the last electrolysis tank or in the rear group of electrolysis tanks, preferably has a weight portion of chromium oxides, including chromium hydroxides, of more than 90%, most preferably of more than 95%. This ensures a good adhesive base with good adhesive strength for organic coatings, such as paints or polymer layers of thermoplastic materials, such as PET or PP.

To electrolytically deposit the layers onto the metal strip, the metal strip, which may, for example, be an initially uncoated steel strip (blackplate strip) or a tin-plated steel strip (tinplate strip), is first brought into contact with the first electrolyte solution in the first electrolysis tank or in the front group of electrolysis tanks during a first electrolysis time t1 and is subsequently brought into contact with the second electrolyte solution in the second electrolysis tank or in the rear group of electrolysis tanks during a second electrolysis time t2. The overall electrolysis time tG=t1+t2 is preferably in a range of 0.5 to 5.0 seconds and most preferably between 1.0 and 1.5 seconds. To this end, the metal strip is successively passed at a predefined strip travel speed through the electrolysis tanks successively connected to each other in the strip travel direction, said strip travel speed being at least 100 m/min and preferably being in a range of 200 m/min to 750 m/min. Because of the high strip travel speeds, it can be ensured that the method is highly efficient.

At the preferred strip travel speeds, the first electrolysis time, during which the metal strip is in electrolytically effective contact with the first electrolyte solution, is shorter than 2.0 seconds, and the second electrolysis time, during which the metal strip is in electrolytically effective contact with the second electrolyte solution, is preferably also shorter than 2.0 seconds.

The electrolysis times in the last electrolysis tank or in the rear group of electrolysis tanks are preferably set by means of the strip travel speed such that the layer of chromium oxide deposited from the second electrolyte solution has a total coating weight of chromium oxide of at least 3 $mg/m^2$ and preferably of 7 $mg/m^2$ to 10 $mg/m^2$. The coating weights of chromium oxide ensure a sufficiently high corrosion resistance and provide a good adhesive base for organic top coats, such as paints or thermoplastic films. To ensure a sufficiently high corrosion resistance for use in packaging applications, the uppermost layer preferably has a coating weight of chromium oxide of at least 5 $mg/m^2$, most preferably of more than 7 $mg/m^2$.

To improve the corrosion resistance and to create a barrier against sulfur-containing materials, especially against sulfide- or sulfite-containing packing fillers used in packaging materials, after the electrolytic deposition of the coating, it is therefore possible without difficulty to deposit a coating of an organic material, especially a paint or a thermoplastic material, more particularly a polymer film of PET, PE, PP or a mixture thereof, which well adheres to the top chromium oxide layer of the coating, onto the surface of the coating (i.e., onto the uppermost layer of chromium oxide/chromium hydroxide).

To ensure a method that is completely free of chromium (VI)-containing substances, it is recommended that for the electrolytic deposition of the coating, a suitable anode be used and placed into the electrolysis tanks which prevents oxidation of chromium(III) from the trivalent chromium compound of the electrolyte solution to chromium(VI). It has been found that especially anodes with an outside surface or a coating of a metal oxide, in particular iridium oxide, or of a mixed metal oxide, in particular iridium-tantalum oxide, are well suited for this purpose. The anode preferably does not contain either stainless steel or platinum. Using such anodes makes it possible to deposit coatings onto blackplate or tinplate steel which exclusively contain trivalent chromium oxides and/or chromium hydroxides, especially $Cr_2O_3$ and/or $Cr(OH)_3$.

As in any galvanic process, during galvanic chromium plating from a chromium(III) electrolyte, at least one anodic oxidation, in addition to the cathodic reduction, takes place. During galvanic chromium plating from a chromium(III) electrolyte, the anodic oxidation includes the oxidation of Cr(III) to Cr(VI) on the one hand, and the oxidation of water to oxygen on the other. In the electrochemical series, both potentials are located in close proximity to each other:

$$Cr^{6+}+3\ e^- \rightleftharpoons Cr^{3+}+1.33\ V \qquad (1)\ \text{Chromium(Cr)}$$

$$O_2+4\ H^++4\ e^- \rightleftharpoons 2\ H_2O+1.23\ V \qquad (2)\ \text{Oxygen(O)}$$

The potentials are measured in the associated Daniell cell. It should be noted that the potential of the redox equation depends on the anode material used. Therefore, the anode material used is the critical determinant of whether reaction (1) is suppressed and reaction (2) takes place exclusively. To prevent the formation of $Cr^{6+}$ while implementing the method according to the present disclosure, it is possible to use, for example, anodes based on metal oxides, especially iridium oxide, or mixed metal oxides, for example, mixed metal oxides consisting mainly of multi-layer coatings of tantalum oxide and iridium oxide in order to suppress the reaction 1. The anodes can have an outside surface or an outside coating of a mixed metal oxide. Anodes with a core of titanium and an outside coating of a tantalum oxide-iridium oxide have been shown to be especially well-suited for this purpose. Using such anodes, it was possible to demonstrate by means of polarographic measurements (dropping mercury electrode) that no Cr(VI) forms.

When anodes made of stainless steel are used, the oxidation of Cr(III) to Cr(VI) (reaction 1) is not (sufficiently) suppressed. Comparative measurements with stainless steel anodes point to a distinctly detectable Cr(VI) concentration after a total coating time of only a few seconds. This indicates that the use of stainless steel as anode material does at least not completely suppress the oxidation of Cr(III) to Cr(VI). This leads to an accumulation of Cr(VI) in the Cr(III) electrolyte and thus to a different deposition mechanism. Therefore, in the method according to the present disclosure, preferably anodes are used which are free of stainless steel. This makes it possible to ensure that no Cr(VI) forms during the electrolysis and that the deposited coating contains only Cr(III) compounds and metallic chromium. Furthermore, this obviates the need for a post-treatment, e.g., with thiosulfate, which would otherwise be required if stainless steel anodes were used for the reduction of deposited Cr(VI) to Cr(III).

Since already in the first electrolysis tank or in the front group of electrolysis tanks and, where applicable, in one of the middle electrolysis tanks or in a middle group of electrolysis tanks, chromium oxide, including chromium hydroxide, accounts for a certain weight portion of the total coating weight of the deposited coating, which is typically 9 to 25%, chromium oxide crystals form already in the first electrolysis tank or in the front group of electrolysis tanks and in the middle electrolysis tank or in the middle group of electrolysis tanks on the surface of the metal strip. In the last electrolysis tank and/or in the rear group of electrolysis tanks, these chromium oxide crystals act as a nuclear cell for the growth of additional oxide crystals, which explains why the efficiency of the deposition of chromium oxide or, more specifically, the portion of chromium oxide relative to the total coating weight of the coating is improved in the last electrolysis tank or in the rear group of electrolysis tanks. Thus, it is possible to efficiently produce a sufficiently high coating weight of chromium oxide, including chromium hydroxide, of preferably more than 5 mg/m$^2$ on the surface of the coating.

The strip travel speed of the metal strip is preferably set so that in each of the electrolysis tanks, the electrolysis time (tE), during which the metal strip is in electrolytically effective contact with the electrolyte solution, is shorter than 2.0 seconds and is especially in a range of 0.5 to 1.9 seconds, preferably shorter than 1.0 second and most preferably in a range of 0.6 seconds to 0.9 seconds. This ensures a higher efficiency of the process, on the one hand, and the deposition of a coating with a sufficiently high total coating weight of preferably at least 40 mg/m$^2$ and especially of 70 mg/m$^2$ to 180 mg/m$^2$ of chromium in the coating, on the other. The weight portion of chromium oxide contained in the coating relative to the total coating weight of the coating is preferably greater than 10%, more preferably greater than 20%, and most preferably in a range of 25 to 50%.

When summed up over all of the electrolysis tanks, the total electrolysis time (tE), during which the metal strip is in electrolytically effective contact with the electrolyte solution (E), is preferably shorter than 16 seconds and is especially in a range of 3 to 16 seconds. The total electrolysis time is most preferably shorter than 8 seconds and is especially in a range of 4 seconds to 7 seconds.

As a result of the configuration of the electrolysis tanks, through which the metal strip is passed in the strip travel direction, the coating is deposited layer by layer, which, depending on the current density set in each electrolysis tank and on the composition of the electrolyte solution, causes a layer with a different composition, especially with a different chromium oxide portion in each layer, to be produced in each of the electrolysis tanks. Thus, for example, in the first electrolysis tank or in the front group of electrolysis tanks, a layer containing chromium metal and chromium oxide/chromium hydroxide with a weight portion of chromium oxide, including chromium hydroxide, of less than 15%, especially of 6 to 10%, can be deposited onto the surface of the metal strip, and in the last electrolysis tank or in the rear group of electrolysis tanks, a layer consisting, at least for the most part, of pure chromium oxide and/or chromium hydroxide can be deposited.

The first and the second electrolyte solution preferably have each a temperature in the range of 20° C. to 65° C., more preferably in the range of 30° C. to 55° C. and most preferably in a range of 35° C. to 45° C. At these temperatures, the electrolytic deposition of the layers is extremely efficient. In this context, any reference to the temperature of the electrolyte solution or to the temperature in an electrolysis tank is intended to signify the mean temperature which results as the average over the overall volume of an electrolysis tank. As a rule, there is a temperature gradient with increasing temperature from top to bottom in the electrolysis tanks.

In addition to the trivalent chromium compound, both the first electrolyte solution and the second electrolyte solution preferably contain each at least one conductivity-increasing salt and at least one acid or base for setting a suitable pH value. Both the first electrolyte solution and the second electrolyte solution are preferably free of chloride ions and free of buffering agents, especially free of a boric acid buffer.

The trivalent chromium compound of the first electrolyte solution and/or the second electrolyte solution is preferably selected from the group which comprises basic Cr(III) sulfate ($Cr_2(SO_4)_3$), Cr(III) nitrate ($Cr(NO_3)_3$), Cr(III) oxalate ($CrC_2O_4$), Cr(III) acetate ($C_{12}H_{36}ClCr_3O_{22}$), Cr(III) formate ($Cr(OOCH)_3$) or a mixture thereof. The concentration of the trivalent chromium compound in the first electrolyte solution and/or in the second electrolyte solution is preferably at least 10 g/L and more preferably more than 15 g/L and most preferably 20 g/L or higher.

To increase the conductivity, both the first electrolyte solution and the second electrolyte solution contain each at least one salt which is preferably an alkali metal sulfate, especially potassium or sodium sulfate.

A highly efficient deposition of a chromium- and/or chromium oxide-containing layer is achieved if the pH value (measured at a temperature of 20° C.) of the first electrolyte solution and/or the second electrolyte solution is in a range of 2.3 to 5.0 and preferably from 2.5 to 2.9. The desired pH value can be set by adding an acid or base to the first and/or second electrolyte solution. If the trivalent chromium compound used is basic Cr(III) sulfate, especially sulfuric acid or an acid mixture containing sulfuric acid can be suitably used to set the desired pH value.

The composition of the first electrolyte solution differs from the second electrolyte solution in that the first electrolyte solution contains organic complexing agents, especially in the form of formates, preferably in the form of potassium formate or sodium formate, whereas the second electrolyte solution is preferably free of complexing agents and especially contains no organic complexing agents, such as formates.

Especially preferred compositions of the first and the second electrolyte solution comprise each basic Cr(III) sulfate ($Cr_2(SO_4)_3$) as the trivalent chromium compound. The concentration of the trivalent chromium compound in the first and in the second electrolyte solution is preferably at least 10 g/L, more preferably higher than 15 g/L, and most preferably 20 g/L or higher.

Other constituents of the first electrolyte solution include a salt for the purpose of increasing the conductivity and organic complexing agents, especially the salts of formic acid, such as potassium format or sodium format [sic; potassium formate or sodium formate]. The ratio of the weight portion of the trivalent chromium compound to the weight portion of the complexing agents, especially the formates, is preferably between 1:1.1 and 1:1.4, more preferably between 1:1.2 and 1:1.3 and is most preferably 1:1.25.

Other than the trivalent chromium-containing substance, i.e., the at least one salt for the purpose of increasing the conductivity and the at least one acid or base for setting the pH value, the second electrolyte, preferably contains no other components. This ensures a simple and cost-effective preparation of the second electrolyte solution.

To produce the second electrolyte solution, the trivalent chromium compound, which was initially freed largely of organic residues, as well as the at least one salt and the at least one acid or base to adjust the desired pH value, are dissolved in water. Since the electrolyte solution contains no complexing agent, the solution thus obtained should preferably be allowed to stand for complexation for at least 5 days, preferably at least 7 days (in atmospheric oxygen). A fine adjustment of the desired pH value can then be conducted by adding an acid or base.

Using the method according to the present disclosure, it is possible to produce metal strips, especially steel strips, with an electrolytically deposited coating which contains chromium and chromium oxide/chromium hydroxide, with the coating being composed of a first layer which faces the surface of the metal strip and a second layer lying on top thereof, and with the first layer containing metallic chromium and the second layer consisting at least for the most part only of chromium oxide and/or chromium hydroxide, preferably only of trivalent chromium oxides and/or chromium hydroxides, and preferably having a weight portion of chromium oxide and/or chromium hydroxide of more than 90%, most preferably of more than 95%.

Inventive metal strips of this type are marked by high corrosion resistance and good adhesive power for organic coatings, such as paints or polymer films. The coating, at least for the most part (i.e., except for unavoidable contaminants), contains only compounds of chromium and oxygen in which the chromium is present in trivalent form, especially in the form of $Cr_2O_3$ and/or $Cr(OH)_3$.

BRIEF DESCRIPTION OF THE DRAWINGS

The disclosure is further explained below by means of embodiment examples with reference to the accompanying drawings, where the aforementioned embodiment examples explain the disclosure only in exemplary terms and do not restrict it with reference to the scope of protection defined in the subsequent claims. The drawings show:

DETAILED DESCRIPTION

Figure 1:
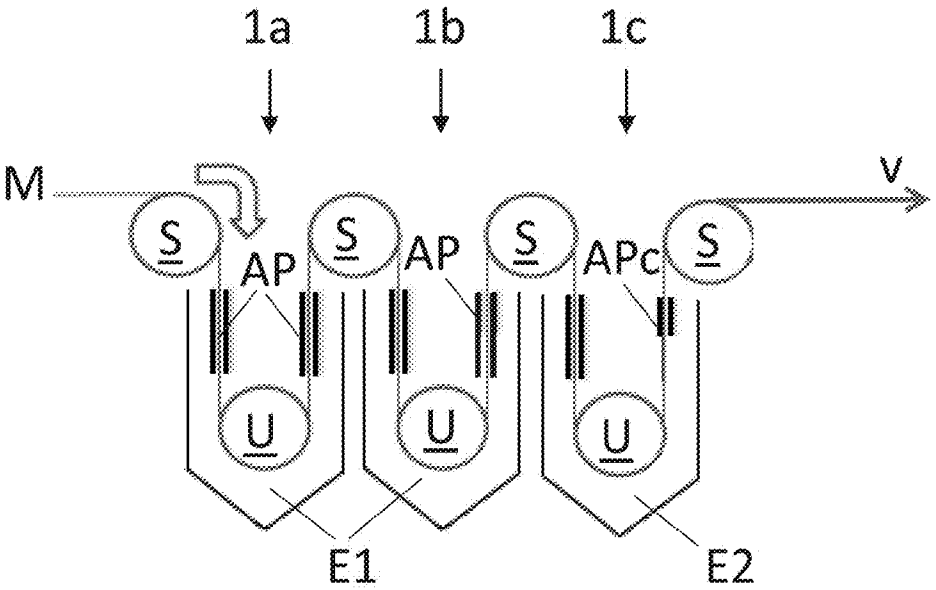
FIG. 1: schematic depiction of a first embodiment example of a strip coating line for the performance of the method according to the disclosure, comprising three electrolysis tanks successively connected to each other in the strip travel direction v.

A strip coating line for performance of the method according to the disclosure is shown schematically in FIG. 1. The strip coating line includes three electrolysis tanks 1*a*, 1*b*, 1*c* arranged one next to or behind the other, each of which is filled with an electrolyte solution E. An initially uncoated metal strip M, for example, a blackplate strip or a tinplate strip, is successively passed through the electrolysis tanks 1*a*-1*c*. To this end, using a conveyor device (not shown), the metal strip M is pulled at a predefined strip travel speed through the electrolysis tanks 1*a*-1*c* in a strip travel direction v. Disposed above the electrolysis tanks 1*a*-1*c* are conductor rollers S, by means of which the metal strip M is connected as the cathode. Also disposed in each electrolysis tank is a guide roller U, around which the metal strip M is guided and thereby moved into and out of the electrolysis tank.

Inside each electrolysis tank 1*a*-1*c*, at least one anode pair AP is disposed below the fluid level of the electrolyte solution E. In the embodiment example illustrated, two anode pairs AP, which are successively connected to each other in the strip travel direction, are disposed in each electrolysis tank 1*a*-1*c*. The metal strip M is passed through between the oppositely disposed anodes of an anode pair AP. Thus, in the embodiment example of FIG. 1, two anode pairs AP are arranged in each electrolysis tank 1*a*, 1*b*, 1*c* such that the metal strip M is successively passed through these anode pairs AP. The downstream last anode pair APc of the last electrolysis tank 1*c*, as viewed in the strip travel direction v, has a shorter length when compared to the lengths of the other anode pairs AP. As a result, with this last anode pair APc, it is possible to generate a higher current density while applying the same amount of electric current.

The metal strip M involved can be an initially uncoated steel strip (blackplate strip) or a tin-plated steel strip (tinplate strip). In preparation for the electrolysis process, the metal strip M is first degreased, rinsed, pickled and rinsed again, and in this pretreated form is subsequently successively passed through the electrolysis tanks 1*a*-1*c*, with the metal strip M being connected as the cathode by supplying electric current via the conductor rollers S. The strip travel speed at which the metal strip M is passed through the electrolysis tanks 1*a*-1*c* is at least 100 m/min and may measure up to 900 m/min.

The front electrolysis tanks 1*a* and 1*b*, as viewed in the strip travel direction v, are each filled with the same electrolyte solution E1. This first electrolyte solution E1 contains a trivalent chromium compound, preferably basic Cr(III) sulfate, $Cr_2(SO_4)_3$. In addition to the trivalent chromium compound, the first electrolyte solution E1 contains at least one organic complexing agent, for example, a salt of formic acid, especially potassium or sodium format [sic; formate]. The ratio of the weight portion of the trivalent chromium compound to the weight portion of the complexing agents, especially the formates, is preferably between 1:1.1 and 1:1.4 and most preferably 1:1.25. To increase conductivity, the first electrolyte solution E1 contains a salt, especially an alkali metal sulfate, for example, potassium sulfate or sodium sulfate. The concentration of the trivalent chromium compound in the first electrolyte solution E1 is at least 10 g/L and most preferably 20 g/L or higher. The pH value of the first electrolyte solution E1 is set to a preferred value between 2.0 and 3.0 and especially to pH=2.7 by adding an acid, for example, sulfuric acid.

The temperature of the first electrolyte solution E1 is expediently equally high in the two front electrolysis tanks 1*a*, 1*b* and is preferably in a range of 25° C. to 70° C. However, the electrolyte solution in the two front electrolysis tanks 1*a*-1*b* can also be set to different temperatures. Thus, for example, the temperature of the electrolyte solution in the middle electrolysis tank 1*b* can be lower than in the front electrolysis tank 1*a* disposed upstream. The temperature of the electrolyte solution in the middle electrolysis tank 1*b* is preferably in a range of 25° C. to 37° C. and is especially 35° C., and the temperature of the first electrolyte solution E1 in the front electrolysis tank 1*a* is preferably in a range of 40° C. to 75° C. and is especially 55° C. Because of the lower temperature of the electrolyte solution E1, the deposition of a chromium/chromium oxide layer with a higher portion of chromium oxide in the middle electrolysis tank 1*b* is promoted.

The rear or, more specifically, last electrolysis tank 1*c*, as viewed in the strip travel direction v, is filled with a second electrolyte solution E2, the composition of which differs from that of the first electrolyte solution E1 at least in that the second electrolyte solution E2 contains no organic constituents and especially no complexing agents. In all other respects, the constituents of the second electrolyte solution E2 can be the same as those of the first electrolyte solution E1. More specifically, the second electrolyte solution E2 also contains a trivalent chromium compound, preferably basic Cr(III) sulfate, $Cr_2(SO_4)_3$, and at least one salt and one acid or base for setting a suitable pH value. The salt which, as in the first electrolyte solution E1, can be an alkali metal sulfate, for example, potassium sulfate or sodium sulfate, serves to increase the conductivity. The concentration of the trivalent chromium compound in the second electrolyte solution E2 is at least 10 g/L and most preferably 20 g/L or higher. The pH value of the second electrolyte solution E2 is set to a preferred value between 2.0 and 5.0 and especially to pH=4.0 by adding the acid or base, for example, sulfuric acid.

The temperature of the second electrolyte solution E2 in the rear electrolysis tank 1*c* is expediently in a range of 25° C. to 70° C., more preferably from 25° C. to 40° C., and is most preferably 35° C.

DC current is applied to the anode pairs AP arranged in electrolysis tanks 1*a*-1*c* so that a sufficiently high current density is present in the electrolysis tanks 1*a*, 1*b*, 1*c* in order to produce electrolytic deposition of a chromium-containing (especially a Cr(III)-containing) layer. The minimum current density required for this purpose is then dependent on the strip travel speed and amounts to about 15 to 20 $A/dm^2$ at a (minimal) strip travel speed of 100 m/min. At higher strip travel speeds, the minimum current density required for electrolytic deposition of a chromium-containing layer increases.

Depending on the strip travel speed, the metal strip M, which is connected as the cathode and which is passed through the electrolysis tanks 1*a*-1*c*, is in electrolytically effective contact with the first electrolyte solution E1 in the two front electrolysis tanks 1*a*, 1*b* during an electrolysis time t1 and is thereafter in electrolytically effective contact with the second electrolyte solution E2 in the rear electrolysis tank 1*c* during an electrolysis time t2. At strip travel speeds between 100 and 700 m/min, the electrolysis time in each of the electrolysis tanks 1*a*, 1*b*, 1*c* is in a range of 0.5 to 2.0 seconds. The strip travel speeds are preferably set at such a high setting that the electrolysis time in each electrolysis tank 1*a*, 1*b*, 1*c* is shorter than 2 seconds and is especially in a range of 0.6 seconds to 1.8 seconds. The total electrolysis time tG=t1+t2+t3, during which the sheet B is in electrolytically effective contact with the first and the second electrolyte solution E1, E2 over all electrolysis tanks 1*a*-1*c*, is accordingly between 1.8 and 5.4 seconds. The electrolysis time in the individual electrolysis tanks 1*a*, 1*b*, 1*c* can be adjusted, on the one hand, by means of the strip travel speed and, on the other hand, by means of dimensioning the electrolysis tanks 1*a*-1*c*.

If the current density in the respective electrolysis tanks 1*a*-1*c* is set higher than the minimum current density, a layer that contains chromium and chromium oxide/chromium hydroxide and chromium carbide and, if a sulfate-containing first electrolyte solution E1 is used, possibly also chromium sulfate, is deposited onto at least one surface of the metal strip M in the front electrolysis tank 1*a* and in the middle electrolysis tank 1*b*. In each of the two electrolysis tanks 1*a*, 1*b*, this leads to the formation of a layer B1 and B2, respectively, the composition of which layers B1, B2, especially with regard to the weight portion of chromium oxide/chromium hydroxide, can differ if the electrolysis parameters used, especially the current densities and temperatures, in the front electrolysis tank 1*a* differ from those in the middle electrolysis tank 1*b*.

In the rear electrolysis tank 1*c*, an upper layer B3 is deposited onto at least one surface of the metal strip M, which layer consists, at least for the most part, of pure chromium oxide and/or chromium hydroxide. The weight portion of chromium oxide/chromium hydroxide relative to the total coating weight of the upper layer B3 expediently accounts for 90%, preferably for more than 95%.

Figure 3:
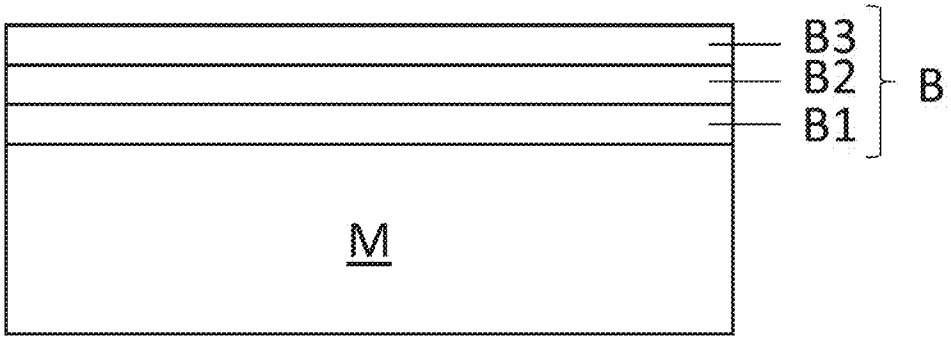
FIG. 3: a sectional drawing of a metal strip coated by means of the method according to the present disclosure as described in the first embodiment example.

FIG. 3 shows a diagrammatic sectional drawing of a metal strip M which has been electrolytically coated using the method according to the present disclosure. One surface of the metal strip M is coated with a coating B which is composed of the individual layers B1, B2, B3.

Each individual layer B1, B2, B3 is applied to the surface in one of the electrolysis tanks 1*a*, 1*b*, 1*c*.

The two lower layers B1, B2 facing the surface of the metal strip M contain metallic chromium (chromium metal) and chromium oxides (CrOx)/chromium hydroxides and chromium carbides and, where applicable, chromium sulfates as main constituents, with the composition of the individual layers B1, B2, especially with regard to the weight portion of chromium metal and chromium oxide/chromium hydroxide contained in each, being the same or different, depending on whether the same or different electrolysis parameters were used in the two front electrolysis tanks 1*a*, 1*b*. The upper layer B2 facing away from the surface of the metal strip M for the most part contains only chromium oxides (CrOx) and/or chromium hydroxides and especially no chromium carbides and hardly any metallic chromium and chromium sulfates.

Figure 4:
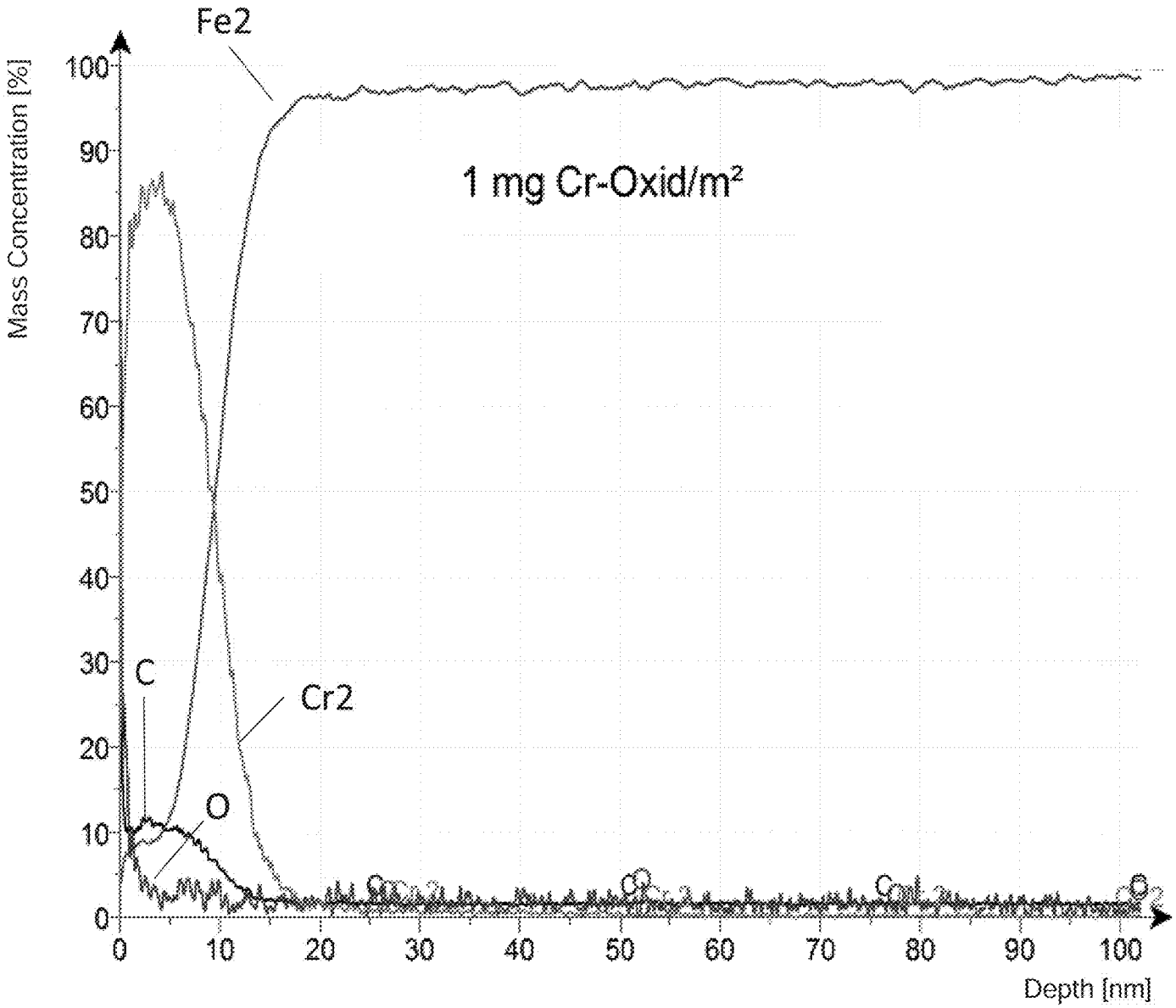
FIG. 4: GDOES spectrum of a layer which has been electrolytically deposited onto a steel strip, using an electrolyte solution containing a trivalent chromium substance (basic Cr(III) sulfate) and an organic complexing agent (sodium formate), which layer contains chromium metal, chromium oxide and chromium carbide, with the chromium oxide being located mainly on the surface of the layer.

The layer buildup of the layers B1, B2, B3 deposited onto the metal substrate can be demonstrated by means of GDOES spectra (Glow Discharge Optical Emission Spectroscopy). In the two front electrolysis tanks 1*a*, 1*b*, first a metallic chromium layer with a thickness of 10-15 nm is deposited on the metal strip M. The surface of this layer oxidizes and consists mainly of chromium oxide in the form of $Cr_2O_3$ or of mixed oxide/hydroxide in the form of $Cr_2O_2(OH)_2$. This oxide layer is only few nanometers thick. In addition, chromium carbon and chromium sulfate compounds form as a result of the reduction of the organic complexing agent and the sulfate of the electrolyte solution, respectively, which compounds are uniformly distributed throughout the entire layer. In the first nanometers of the layer, typical GDOES spectra of the layers B1, B2 which have been deposited in the individual electrolysis tanks show a sharp increase in the oxygen signal, from which it is possible to conclude that the oxide layer is concentrated on the surface of the particular layer (FIG. 4).

The composition of the layers can be determined according to the EURO Standard DIN EN 10202 (Cr oxides, photometric: (European standard), step 1: 40 mL of NaOH (330 g/L), reaction at 90° C. for 10 minutes, oxidation with 10 mL of 6% $H_2O_2$, photometric@370 nm).

Following the electrolytic deposition of the coating, the metal strip M coated with the coating B is rinsed, dried and oiled (for example, with DOS oil). Subsequently, an organic cover coat can be applied to the metal strip M which has been electrolytically coated with the coating B.

The organic cover coat is applied by conventional means, for example, by painting or laminating a plastic film onto the surface of the coating B, i.e., onto the top layer B3 of chromium oxide/chromium hydroxide. The top layer B3 of chromium oxide/chromium hydroxide provides an excellent adhesive base for the organic material of the cover coat. The cover coat can be, for example, an organic paint or polymer films of thermoplastic polymers, such as PET, PE, PP or mixtures thereof. The organic top coat can be applied, for example, in a "coil coating" process or in a plate process, in which the coated metal strip in the plate coating process is initially divided into plates that are then painted with an organic paint or coated with a polymer film.

Figure 2:
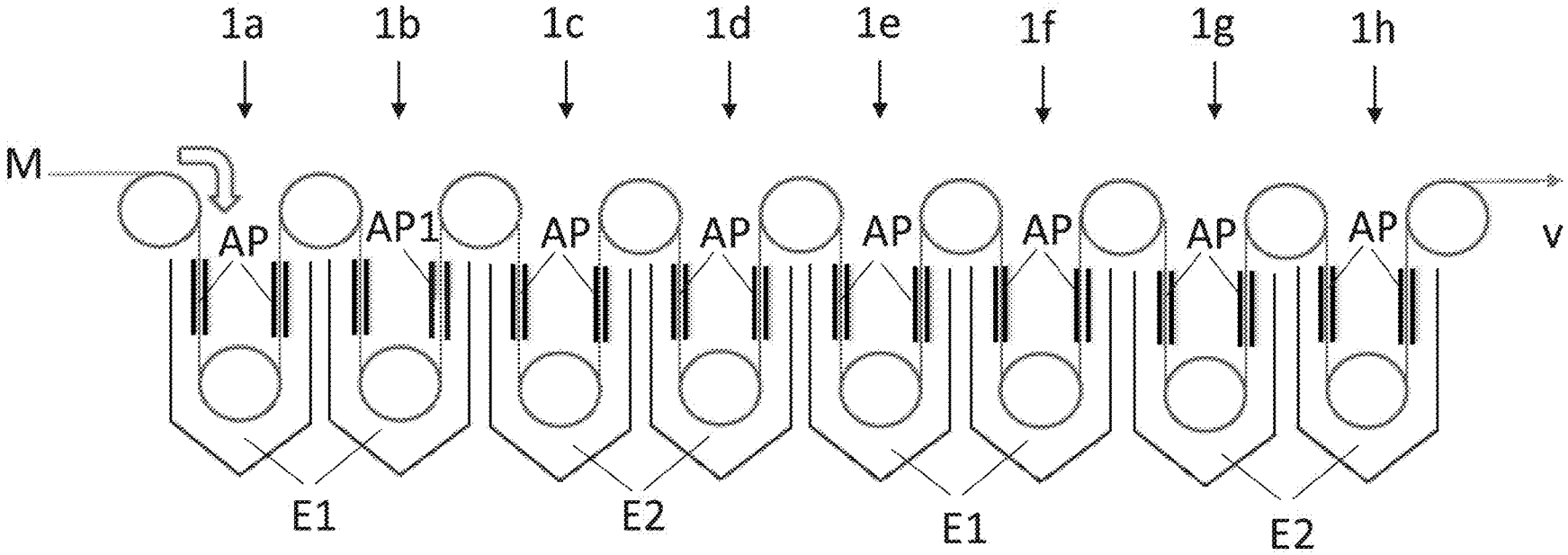
FIG. 2: schematic depiction of a second embodiment example of a strip coating line for the performance of the method according to the present disclosure, comprising eight electrolysis tanks successively connected to each other in the strip travel direction v.

FIG. 2 shows a second embodiment example of a strip coating line with eight electrolysis tanks 1*a*-*h* successively disposed one after the other in the strip travel direction v. The electrolysis tanks 1*a*-*h* are arranged in three groups, i.e., a front group comprising the first two electrolysis tanks 1*a*, 1*b*, a middle group comprising the electrolysis tanks 1*c*-1*f* following downstream in the strip travel direction, and a rear group comprising the two last electrolysis tanks 1*g* and 1*h*.

The electrolysis tanks 1*a*, 1*b* of the front group and the electrolysis tanks 1*c*, 1*d*, 1*e*, 1*f* of the middle group are each filled with the first electrolyte solution E1 which contains organic complexing agents, especially formates. The electrolysis tanks 1*g*, 1*h* of the rear group are filled with the second electrolyte solution E2 which is free of organic substances and especially free of complexing agents.

With a strip coating line configured as shown in FIG. 2, it is possible to create the same layer buildup with the layers B1, B2 and B3 as with the strip coating line shown in FIG. 1. However, by arranging the electrolysis tanks 1*a* to 1*h* in groups, the overall electrolysis time can be increased. This makes it possible to operate at a higher strip travel speed or to increase the coating weights of the layers B1, B2, B3 while maintaining the same strip travel speed.

To ensure a sufficiently high corrosion resistance for packaging applications, the coatings B preferably have a total coating weight of chromium of at least 40 mg/m$^2$ and most preferably of 70 mg/m$^2$ to 180 mg/m$^2$. When summed up over the overall weight of the deposited coating B, the weight portion of chromium oxide/chromium hydroxide relative to the total coating weight of chromium accounts for at least 15% and is preferably in a range of 20% to 40%. The coating B preferably has a total chromium oxide portion with a coating weight of chromium bound in the form of chromium oxide and/or chromium hydroxide of at least 3 mg of chromium per m$^2$ and especially in a range of 3 to 15 mg/m$^2$. When summed up over the overall weight of the deposited coating B, the coating weight of chromium bound in the form of chromium oxide and/or chromium hydroxide accounts for at least 5 and preferably for more than 7 mg of chromium per m$^2$. Good adhesive strength for organic paints or thermoplastic polymer materials on the surface of the coating B can be achieved with coating weights of chromium oxide/chromium hydroxide of up to approximately 15 mg/m$^2$. Consequently, a preferred coating weight of chromium oxide/chromium hydroxide in the coating B is in a range of 5 to 15 mg/m$^2$.

The thickness and the respective coating weight of the individual layers B1, B2, B3 can be adjusted in the depicted embodiment example of the method according to the disclosure by means of the electrolysis times t1, t2, t3 and the current density in the electrolysis tanks. As soon as a sufficiently high current density has been set in the electrolysis tanks, the thickness and the respective coating weight of the deposited layers B1, B2, B3 no longer depends on the current density but (with the electrolyte solution being maintained at the same the temperature) only on the electrolysis time t1, t2, during which the metal strip M is in electrolytically effective contact with the first and the second electrolyte solution E1, E2.

Thus, the weight portion of chromium oxide/chromium hydroxide relative to the total coating weight of the coating B can be determined by setting the electrolysis time t2 during which the metal strip M in the rear electrolysis tank 1*c* or in the rear group of electrolysis tanks 1*g*, 1*h* is in electrolytically effective contact with the second electrolyte solution E2. This electrolysis time t2 in turn depends on the dimensions of the rear electrolysis tank 1*c* and 1*g*, 1*h* and on the strip travel speed.

The invention claimed is:

1. A method of producing a metal strip coated with a coating, the coating containing chromium metal and at least one of chromium oxide and chromium hydroxide and being electrolytically deposited from an electrolyte solution, onto the metal strip by bringing the metal strip, during an electrolysis time, into electrolytically effective contact with the electrolyte solution, the method comprising:

successively passing the metal strip at a predetermined strip travel speed through a plurality of electrolysis tanks successively disposed in a strip travel direction, the plurality of electrolysis tanks comprising at least a first electrolysis tank or a front group of electrolysis tanks comprising several electrolysis tanks, and, as viewed in the strip travel direction, a last electrolysis tank or a rear group of electrolysis tanks comprising several electrolysis tanks, wherein the first electrolysis tank or each of the electrolysis tanks of the front group of electrolysis tanks is filled with a first electrolyte solution and the last electrolysis tank or each of the electrolysis tanks of the rear group of electrolysis tanks is filled with a second electrolyte solution, wherein the first electrolyte solution comprises a trivalent chromium compound, at least one salt for increasing a conductivity of the first electrolyte solution, at least one acid or base for setting a desired pH value of the first electrolyte solution, and organic complexing agents; and wherein the second electrolyte solution consists of a trivalent chromium compound, and at least one salt and at least one acid or base and is free of organic complexing agents and free of buffering agents.

2. The method of claim 1, wherein a layer containing chromium oxide and/or chromium hydroxide is deposited onto the metal strip in the last electrolysis tank or in the rear group of electrolysis tanks.

3. The method of claim 2, wherein the layer containing chromium oxide and/or chromium hydroxide has a weight portion of more than 90% of a total coating weight of the coating deposited onto the metal strip.

4. The method of claim 1, wherein the metal strip is successively passed at a predefined strip travel speed through the plurality of electrolysis tanks, the strip travel speed is at least 100 m/min, and the metal strip is brought into electrolytically effective contact with the first electrolyte solution during a first electrolysis time and into electrolytically effective contact with the second electrolysis solution during a second electrolysis time, with a total electrolysis time being in a range of 0.5 to 6.0 seconds, and wherein the first electrolysis time, during which the metal strip is electrolytically effectively in contact with the first electrolyte solution, is shorter than 2.0 seconds, and wherein the second electrolysis time, during which the metal strip is electrolytically effectively in contact with the second electrolyte solution, is shorter than 2.0 seconds.

5. The method of claim 1, wherein each of the first and the second electrolyte solutions has a temperature, averaged over a volume of an electrolysis tank of the plurality of electrolysis tanks, in a range of 20° C. to 65° C.

6. The method of claim 1, wherein the trivalent chromium compound of the first electrolyte solution and the second electrolyte solution is at least one of a basic Cr(III) sulfate ($Cr_2(SO_4)_3$), a Cr(III) nitrate ($Cr(NO_3)_3$), a Cr(III) oxalate ($CrC_2O_4$), a Cr(III) acetate ($C_{12}H_{36}ClCr_3O_{22}$), a Cr(III) formate ($Cr(OOCH)_3$) and mixtures thereof, and the at least one salt of the first electrolyte solution and the second electrolyte solution includes at least one alkali metal sulfate, and wherein the first electrolyte solution and the second electrolyte solution are free of halides and free of chloride ions and bromide ions.

7. The method of claim 1, wherein the first electrolyte solution and the second electrolyte solution each have a pH value, measured at a temperature of 20° C., in a range of 2.3 to 5.0, wherein the pH value is set by adding at the least one acid to the first and the second electrolyte solutions.

8. The method of claim 1, wherein a concentration of the trivalent chromium compound in at least one of the first electrolyte solution and the second electrolyte solution is at least 10 g/L.

9. The method of claim 1, wherein a total coating weight of chromium oxide and/or chromium hydroxide of a layer of chromium oxide/chromium hydroxide deposited from the second electrolyte solution is at least 3 mg/m$^2$.

10. The method of claim 1, further comprising, after the coating has been electrolytically deposited onto the metal strip, applying a cover coat of organic material to a surface of the coating.

11. The method of claim 1, further comprising using an anode during the electrolytic deposition of the coating to prevent oxidation of the chromium(III) from the trivalent chromium compound of the first and second electrolyte solutions to chromium(VI).

12. The method of claim 11, wherein the anode is free of stainless steel and platinum.

13. The method of claim 12, wherein the anode has an outside surface or a coating of metal oxide or a coating of mixed metal oxide.

14. The method of claim 1, further comprising preparing the second electrolyte solution, wherein preparing the second electrolyte solution includes:

providing a trivalent chromium compound including organic residues, liberating the trivalent chromium compound from the organic residues, dissolving the trivalent chromium compound which has been liberated of the organic residues, together with the at least one salt and a first part of the at least one acid or base for the purpose of setting an initial pH value in water to obtain a solution, complexing the solution by allowing the solution to stand for at least 5 days, and adjusting the pH value of the solution to a desired pH value by adding a second part of the at least one acid or base to obtain the second electrolyte solution.

* * * * *